United States Patent [19]

Stevens

[11] 4,255,484

[45] Mar. 10, 1981

[54] FABRIC-CONDITIONING COMPOSITION FOR ARTICLE USED TO CONDITION FABRICS IN A CLOTHES DRYER

[75] Inventor: Frank H. Stevens, St. Charles, Ill.

[73] Assignee: A. E. Staley Manufacturing Company, Decatur, Ill.

[21] Appl. No.: 70,600

[22] Filed: Aug. 29, 1979

[51] Int. Cl.[3] ..... D06M 13/00

[52] U.S. Cl. ..... 428/286; 252/8.6; 252/8.7; 252/8.75; 252/8.8; 252/91; 428/287; 428/290

[58] Field of Search ..... 428/286, 287, 290; 252/91, 8.6, 8.7, 8.75, 8.8

[56] References Cited

U.S. PATENT DOCUMENTS

| | | | |
|---|---|---|---|
| 4,022,938 | 5/1977 | Zaki | 252/8.6 |
| 4,127,694 | 11/1978 | Murphy | 252/91 |

*Primary Examiner*—Marion McCamish

[57] ABSTRACT

A fabric-conditioning composition incorporated in an article used to condition fabrics in a laundry dryer. The fabric-conditioning composition carried on a sheet-like flexible substrate includes special fatty glyceride spreading agents to enhance uniform transfer of the conditioning agents to fabrics when tumbled therewith in a clothes dryer. The article is capable of effective conditioning fabrics without staining because of the spreading agents which aid in the uniform release of fabric-conditioners from the substrate at dryer operating temperatures, and aids in uniformly spreading the fabric-conditioners over the clothes being treated. The presently preferred fatty glyceride spreading agents comprise ethoxylated, propoxylated glycerol and mono- and diesters of hydrogenated tallow acids. These spreading agents are preferably used with a cationic quaternary ammonium fabric-conditioner, more particularly ditallow and dimethyl ammonium sulfate. Other fabric-conditioning materials which may be used include other cationic fabric-conditioners, nonionic and anionic surfactants, perfumes, brighteners, crisping agents, sizing materials and combinations of these. The preferred mode of use is in the clothes dryer, but the article may also be used in the washing machine, preferably in the rinse cycle.

8 Claims, No Drawings

FABRIC-CONDITIONING COMPOSITION FOR ARTICLE USED TO CONDITION FABRICS IN A CLOTHES DRYER

BACKGROUND OF THE INVENTION

1. Field of the Invention

Fabric-conditioning has taken on increasing importance with increased use of synthetic fibers in articles of clothing. Such synthetic fabrics are usually initially treated with conditioning agents by the manufacturers, but washing or dry cleaning the fabrics tends to remove the conditioning agents.

Various methods have been proposed to apply fabric-conditioning agents to fabrics to improve their various properties. Such fabric-conditioning agents include softeners, antistats, lubricants, bacteriostats, mildew-proofers, moth-proofers and the like. The methods of application include treatment of the fabrics by padding, dipping, spraying, and rinsing with liquid solutions of the condition agents.

The inconvenience of adding fabric softeners at the rinse cycle has generated interest in fabric-conditioning products which may be added to the clothes dryer to tumble with, and thereby condition, the drying clothes. Applying fabric-softeners in the dryer offers an important convenience because the softeners can be added at the time the clothes dryer is loaded. In addition, the softeners can be applied directly from a solid substrate in solid form, as contrasted with the dilute solutions used in the final rinse cycle of the clothes washing process.

Two important considerations for a fabric-conditioning article used in the clothes dryer are: first, that it be capable of transferring conditioning materials to the fabrics uniformly without staining; and, second, that it remain in effective contact with the clothes when tumbled therewith. Some of the prior conditioning compositions tended to stain the fabrics due to spotty, irregular transfer. The success of the article depends on uniform release and transfer of the conditioning agents to the fabrics being treated to obtain sightly and effectively conditioned clothes.

2. Prior Art

Dryer-administered fabric-softeners are disclosed in U.S. Pat. Nos. 3,442,692; 3,686,025; 3,895,128; 3,944,694; 3,967,008; 4,000,340; 4,022,938; 4,127,694 and others. Commercially available fabric-softener articles include flexible non-woven substrates carrying softeners, and polyurethane sponges carrying fabric-softeners. A third type comprises a fabric bag containing powdered fabric-softeners. The bag containing the softeners is secured to a surface on the dryer drum. The softener is said to be released from the bag, and to transfer to the clothes tumbled in the dryer over a number of dryer loads. Other types of carrier articles have been proposed, including styrofoam articles impregnated with fabric-softeners and other dispensing devices which may be fixed to a wall of the dryer in such a way as to contact the tumbling clothes.

U.S. Pat. No. 4,000,340 is directed to a dryer-administered fabric-softener article in which the main component is a "crisping agent." Such "crisping agents" include alcohols, carboxylic acids and carboxylic acid salts. Adjuncts for such crisping agents are also disclosed, and include "waxy" esters, that is mono-, di- and triglyceride carboxylic acid esters. The dispensing means described include hollow sponges, cloth, or paper bags, sheets of paper or woven or non-woven fabric, preferably having an open or porous structure.

Various sorbitan adjuvant products in combination with a dryer administered fabric-softener article are disclosed in U.S. Pat. No. 4,022,938. Release functions are described for these compounds, which are used with a major amount of cationic fabric-softeners. There is no mention here of fatty glyceride spreading agents.

U.S. Pat. No. 4,127,694 issued Nov. 28, 1978, discloses the combination of water-soluble nonionic antistatic agents in combination with glyceride softeners, which do not have substantial antistatic properties. Because the antistatic agents are water-soluble, they are preferably applied in the clothes dryer. The glyceride materials used are mixtures of mono-, di-, and triglycerides having flow properties in the dryer operating temperature range, said to provide even distribution of the nonionic fabric-conditioning materials onto the clothes in an automatic dryer. The substrate materials include sponges, cloth or paper bags, flexible paper, and woven or non-woven cloth. Optional ingredients include quaternary ammonium antistatic and fabric-softening agents, but the quaternary ammonium compound replaced only one-tenth of the glyceride mixture in Example II (Column 11, lines 24–27).

SUMMARY OF THE INVENTION

This invention is directed to a fabric-conditioning article impregnated with a fabric-conditioner composition which includes a fatty glyceride spreading agent to enhance uniform transfer of fabric-conditioning agents from the article to fabrics with which the article is tumbled. The fabric-conditioner composition preferably comprises about 60–80% by weight of a cationic fabric-softener composition and about 5–15% of a selected nonionic surfactant, more particularly, an ethoxylated, stearic acid type surfactant.

A typical substrate which may be employed in the subject fabric-conditioner article is a rayon-polyester blend which may be manufactured by well-known carded web methods. During manufacture of the substrate, a stiffening substance may be applied to prevent the substrate from folding-over on itself during use. The stiffening substance should retain its function at the elevated temperatures experienced in the clothes dryer, which normally do not exceed about 205° F. Resinous materials which do not crack, and remain fairly stiff, but pliable, in the dryer operating temperature range are preferred. More particularly, the presently preferred stiffening material is a melamine formaldehyde cross-linked acrylic resin which remains solid at the elevated temperatures experienced in the dryer. Other stiffening materials can be used which have the same properties. In addition, the stiffening materials should not interfere with the subsequent release and transfer of the fabric-conditioning materials to the substrate.

DETAILED DESCRIPTION OF THE INVENTION

1. Substrate

The presently preferred carrier for the fabric-conditioner composition is a flexible substrate which can be any cellulosic or noncellulosic material, or blends of these, and which is capable of carrying the fabric-conditioner material thereon in a manner suitable for ready transfer. The substrate is first coated with a stiffening substance, such as a melamine formaldehyde crosslinked acrylic resin, and then the fabric conditioner materials are applied over the coated substrate. The substrate should be capable of releasing sufficient fabric-conditioning materials to condition the load of clothes with which it is tumbled.

There are many possible substrate materials, but one presently preferred substrate is a non-woven, cellulosic acetate, fibrous material made by a carded web technique, which is capable of absorbing a measured amount of fabric-conditioner on both surfaces thereof. Also useful are cellulosic acetate/polyester blends, and straight polyester non-woven materials, either air-laid or water-laid.

The stiffening substance for the substrate imparts sufficient rigidity to minimize folding-over of the fabric-conditioner article during use, and to thereby improve the transfer of fabric-conditioner to the fabrics with which it is tumbled. A desirable stiffening effect can be otained by coating the substrate with a thermosetting resin material which remains solid, but pliable, at the dryer operating temperature range of about 140° F. to 205° F. The resin material may be applied from an aqueous solution, which includes a suitable crosslinker which crosslinks with the resin to form a stiff, but pliable, coating on the substrate. The coating holds the substrate fibers in place where they intersect, and preserves the voids in the substrate. The voids are subsequently filled with fabric-conditioner. The crosslinked resin coating is heated after application to dry it, and to initiate the crosslinking reaction, thereby curing the resin. The presently preferred stiffening agent is a melamine formaldehyde crosslinked, thermosetting resin. The presently preferred crosslinker for the binder system is an alkylated amino crosslinking agent which reacts with polymers containing carboxyl, hydroxyl and amide groups. The preferred alkylating agent for the crosslinker is methanol, and such crosslinking agents are compatible with most water-soluble resins. Such crosslinkers are available from American Cyanamid, Inc., and others.

Presently preferred polymer materials are in the Rhoplex series, available from Rohm and Haas, Inc., Philadelphia, Pennsylvania. Rhoplex TR 934 is one of a large group of aqueous-based acrylic emulsions for bonding non-woven fabrics, and it is particularly useful on the subject substrate because it allows the substrate to remain pliable after it has been cured, even in the heat of the clothes dryer during use. Other thermosetting resins which become brittle in the heated dryer are not useful. In addition to the above described combination, other stiffening agents are contemplated, provided they result in a stiff, but pliable, substrate which remains flexible in the dryer operating temperature range.

Several other possible crosslinkers include benzoguanamine, and urea. For convenience and safety, it is preferable that the polymer/crosslinker binder solution be an aqueous system and be capable of forming a relatively stiff but pliable coating on the substrate, which does not crack or become brittle at the dryer operating temperatures.

Other resin systems are considered useful, including various "Resimene" resin compounds which are of the same general type, and some of these substances should also be useful for this same purpose. "Resimenes" are available from Monsanto Corporation, St. Louis, Missouri, and are described as a series of melamine-formaldehyde thermosetting resins. "Resimenes" can also be applied from aqueous systems, and can be modified to produce coatings of good flexibility, and which resist cracking at the dryer operating temperatures. "Resimene 712" and "Resimene 714" both can be used as stiffening agents for the fabric-conditioner substrate. Other possible stiffening resins include AmCy B-65 and AmCy B-60, both alone, and in combination with other resins. "AmCy" products are available from American Cyanamid, Inc.

The resin polymer/crosslinker binder solution is applied to the substrate by spraying, dipping, dripping, or any convenient method. The total amount of binder (dry substance basis) in the binder coated substrate should be about 30% of the total weight thereof prior to application of the fabric conditioner compositions. After the aqueous solution of the resin polymer/crosslinker has been applied to the substrate, the substrate sheet is subjected to elevated temperature to initiate the crosslinking polymerization reaction, and to remove excess water.

2. Fabric-Conditioner Composition

The fabric-conditioner can be any substance which is conveniently transferred to clothes in a clothes dryer to provide the desired "conditioning effect." The most widely used fabric-conditioners at the present are "fabric-softeners" which give the fabric a softer feel or "hand." Such materials as fragrances, antistatic agents, bactericides, color-brighteners, water-repellents and similar substances may also be included as conditioning materials if capbale of transfer from the fabric-conditioner article of the invention to fabrics during the tumbling action of the clothes dryer, with or without heat.

For most effective utilization of the fabric-conditioner article, the fabric-conditioner materials should be selected to have melting points and other physical properties which give controlled and even transfer of the conditioner to the fabrics being conditioned. There are many fabric-conditioners described in the prior art. Some are nonionic, some are anionic and some are Zwitterionic, but at the present time, those conditioners having the greatest commercial use are cationic quaternary ammonium compounds. Examples of such cationic softeners include dimethyl, distearyl ammonium chloride; N-alkyl* dimethyl ammonium chloride; dialkyl, dimethyl ammonium chloride; methyl difatty alkoxy ammonium methyl sulfate; 2,2' bis(stearyldimethyl ammonium) diethyl ether dichloride.

*Alkyl groups include lauryl, cetyl, steryl, coco, soya and tallow.

Trade names include:

Accoquat (Armstrong)
Arquads (Armour)
Adogens (Sherex)
Culverson (Culver)
Varisoft (Sherex)

The fabric-conditioners which can be used include those listed below which contain at least one long-chain group:

1. Cationic quaternary ammonium salts and imidazolinium salts;
2. Nonionic compounds, such as tallow glyceride alkyloxylates, tertiary phosphine oxides, tertiary amine oxides, ethoxylated alcohols, esters, sorbitan esters, alkyl phenols, and amines;
3. Anionic soaps, sulfates and sulfonates, for example, fatty acid soaps, ethoxylated alcohol sulfates, sodium alkyl sulfates, alkyl sulfonates, sodium alkylbenzenesulfonates, and sodium or potassium alkyl glyceryl ether sulfonates;

4. Amphoteric tertiary ammonium compounds;
5. Zwitterionic quaternary ammonium compounds; and
6. Compatible mixtures of one or more compounds of these classes.

The presently preferred fabric-conditioner materials comprises ditallow dimethyl ammonium methyl sulfate in combination with a fatty glyceride spreading agent and a nonionic surfactant. About 75% by weight ditallow dimethyl ammonium methyl sulfate is used, based on the total dry substance weight of the combination, and about 25% by weight (same basis) of other ingredients are used, including the fatty glyceride spreading agent.

In a particularly preferred embodiment, about 60–90% by weight ditallow dimethyl ammonium methyl sulfate is used in combination with 3–40% by weight of a spreading and release agent comprising ethoxylated, propoxylated glycerol and mono- and diesters of hydrogenated tallow acids. Additional ingredients such as perfumes, lubricants, laundry aids, or brighteners may be included. McCutcheon's 1976 Annual lists detergents and emulsifiers which may be used interchangeably, or with slight adjustment as the fabric-conditioning agents in the fabric-conditioning article of the subject invention. Particularly suitable compositions include the following:

| Chemical Class and Formula | Percentage (as is) |
|---|---|
| Dimethyl di (hydrogenated tallow ammonium methyl sulfate | 71.5 |
| Tallow glyceride ethoxylates (nonionic) | 15.0 |
| Stearic acid type, ethoxylated nonionic surfactant | 10.0 |
| Perfume, optical brightener, etc. | 3.5 |

The tallow glyceride "spreading" agents are lipophilic, and insure uniform transfer of the principal fabric-conditioning agents from the fabric-conditioning article to clothing or fabrics being conditioned.

The tallow glyceride ethoxylates may also be described as ethoxylated, propoxylated glycerol, and mono- and diesters of hydrogenerated tallow acids. The tallow glyceride ethoxylates extend the softening range of the softener combination, they are good leveling agents, and prevent too quick release of softeners.

The dimethyl di(hydrogenated tallow) ammonium methyl sulfate listed above is a cationic fabric-softener. It is one of a large group of fabric-conditioners which may be applied to clothing when tumbled, with or without heat, in a clothes dryer. This particular fabric-softener is a member of the group comprising alkyl substituted quaternary ammonium compounds which normally include at least one long chain alkyl group having about 12–22 carbon atoms. The tallow alkyl groups nornally comprise aliphatic chains of 16–20 carbon atoms, and are well-known fabric-softeners and antistatic agents.

The combined fabric-conditioners have a softening point in the range of about 125°–185° F., and more particularly, about 130°–155° F. These particular conditioners are preferred because they transfer evenly, and do not tend to stain the fabrics being softened.

The fabric-conditioners may be applied to the substrates in any of a number of well-known ways, including padding, dipping, roller-applicating, and spraying. For some fabric-conditioner materials, the application is preferably at an elevated temperature to facilitate uniform transfer of the fabric-conditioner materials to the substrate. At the present, the particular fabric-conditioners used are applied by dipping the substrate in a liquid solution of the fabric-conditioner material.

A total of 50–80 grams of fabric-conditioner is applied to each square yard of the fabric-conditioner substrate materials prior to perforating, cutting and packing the articles. This amount of fabric-conditioner will provide adequate softening for the usual dryer load of about 5–7 pounds of clothes and a drying time of about 30–45 minutes.

For mass production manufacture, a continuous web of substrate can be fed through suitable drive-rollers to the fabric-conditioner application station where a controlled amount of fabric conditioner is applied. After the fabric-conditioner has hardened sufficiently, the web can be passed through perforating rollers, and then through a cutting means to cut the web into separate fabric-conditioner articles, which are then packed, either in suitable boxes or in cylinders.

When the fabric-conditioner article is placed in the clothes dryer on top of a load of clothes, it tumbles freely with them to transfer an effective amount of fabric-conditioner to the clothes during the cycle. The fabric-conditioner article may be subdivided into three separate subdivided sections, or into two subsections, for partial loads of clothes, or the individual fabric-conditioner article can be used to condition a large load of clothes.

The fabric-conditioner article may also be used in the rinse cycle of a clothes washer, if desired. The main advantage in such application is that a premeasured amount of fabric conditioner is applied. The same versatility for economy exists when the fabric-conditioner is used in the washing machine. Only the amount of fabric-conditioner in proportion to the load size need be used.

Since many embodiments of this invention may be made and since many changes may be made in the embodiments described, the foregoing is interpreted as illustrative and the invention is defined by the claims appended hereafter.

I claim:

1. An improved fabric-conditioner article particularly adapted for use in a clothes dryer comprising a fabric-conditioning composition carried on a substrate, said fabric-conditioning composition comprising about 60–90% by weight of a cationic fabric-conditioner composition, about 3–40% by weight of ethoxylated, propoxylated glycerol and mono- and diesters of hydrogenated tallow acids, and about 3–15% by weight of a stearic acid type, nonionic surfactant.

2. The fabric-conditioner article of claim 1, in which the cationic fabric-conditioner composition comprises ditallow dimethyl ammonium methyl sulfate.

3. The improved fabric-conditioner article of claim 1, in which the fabric-conditioner is carried on a sheet-like substrate which is impregnated with a stiffening agent selected from the group consisting of alkylated amino crosslinked resins and modified melamine formaldehyde resins which have a good water solubility, resist heat cracking and allow the sheet-like substrate to remain flexible at the dryer operating temperature.

4. An improved fabric-conditioner article particularly adapted for use in a clothes dryer comprising, in combination:

a. a fibrous, sheet-like substrate material selected from the group consisting of cellulosic or non-cellulosic sheet materials and combinations thereof;

b. a stiffening material applied to said substrate to impart stiffness and resilience to said substrate at temperatures in the range of 140°–205° F. (60°–96.1° C.) whereby folding of said substrate when said fabric-conditioner article is tumbled with clothes is minimized; and c. a fabric-conditioner composition carried on said substrate and adapted for transfer to fabrics-commingled therewith, said composition comprising about 60–90% by weight of a cationic quaternary ammonium compound and about 3–40% by weight of nonionic surfactant comprising ethoxylated, propoxylated glycerol and mono- and diesters of hydrogenated tallow acids.

5. The article of claim 4, in which the cationic quaternary ammonium compound comprises ditallow dimethyl ammonium methyl sulfate.

6. The article of claim 5, in which the ditallow dimethyl ammonium methyl sulfate comprises about 75% by weight of said fabric-conditioner composition.

7. The article of claim 4, in which the ethoxylated, propoxylated glycerol mono- and diesters of hydrogenated tallow acid comprise about 3–15% by weight of said fabric-conditioner composition.

8. The article of claim 4, in which the fabric-conditioner composition comprises: about 75.0% by weight dimethyl di(hydrogenated tallow) ammonium methyl sulfate, and at least about 9.0% by weight of nonionic substances including tallow glyceride ethoxylates.

* * * * *